US005088934A

United States Patent [19]

Chow et al.

[11] Patent Number: 5,088,934

[45] Date of Patent: Feb. 18, 1992

[54] ELECTRICAL TERMINAL

[75] Inventors: Hsiu-Shen Chow, Taiwan, China; Leonard Ellentuch, Wallkill, N.Y.

[73] Assignees: Chian Chyun Enterprise Co. Ltd., Taipei Hsien, Taiwan; Resco Inc., Newburgh, N.Y.

[21] Appl. No.: 657,914

[22] Filed: Feb. 20, 1991

[51] Int. Cl.[5] ..... H01R 4/24

[52] U.S. Cl. ..... 439/395; 439/408

[58] Field of Search ..... 439/389–425

[56] References Cited

U.S. PATENT DOCUMENTS

| | | | |
|---|---|---|---|
| 4,018,499 | 4/1977 | Rickards | 439/396 |
| 4,046,446 | 9/1977 | Reavis, Jr. | 439/408 |
| 4,258,973 | 3/1981 | Reynolds et al. | 439/391 |
| 4,538,874 | 9/1985 | Dambach | 439/407 |
| 4,591,223 | 5/1986 | Vahhani | 439/392 |
| 4,749,366 | 6/1988 | McCaffery | 439/396 |

*Primary Examiner*—Joseph H. McGlynn

*Attorney, Agent, or Firm*—Sprung Horn Kramer & Woods

[57] ABSTRACT

An electrical terminal for mechanically holding and electrically contacting an electrically insulated wire or cable. The terminal includes an electrically conductive, elongate, resilient strip having a free first end and a slot, extending in the longitudinal direction from the first end, for receiving the wire or cable. An opening in the strip, which is in communication with the slot, has an internal diameter which is greater than the narrowest width of the slot. To facilitate electrically contacting another terminal, the electrical terminal comprises a base and an electrically conductive, elongate strip attached thereto having a second end for contacting the other terminal. The strip comprises a first element forming the free first end, and a second, separate element forming the second end, the first element being rigidly attached to the base and having a third, opposite end for resiliently supporting the second end of the second element. The second element also has a fourth end, opposite to its second end, which is rigidly attached to the base.

19 Claims, 3 Drawing Sheets

FIG.1
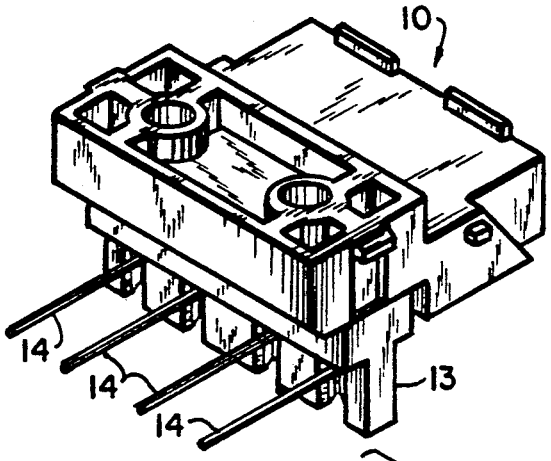
FIG.2
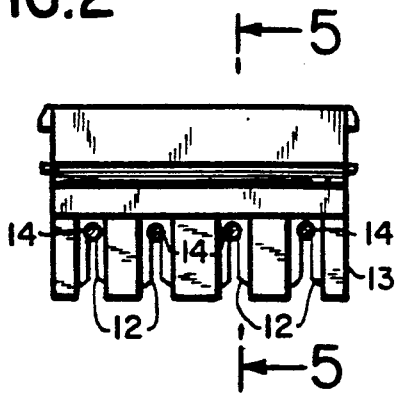
FIG.3
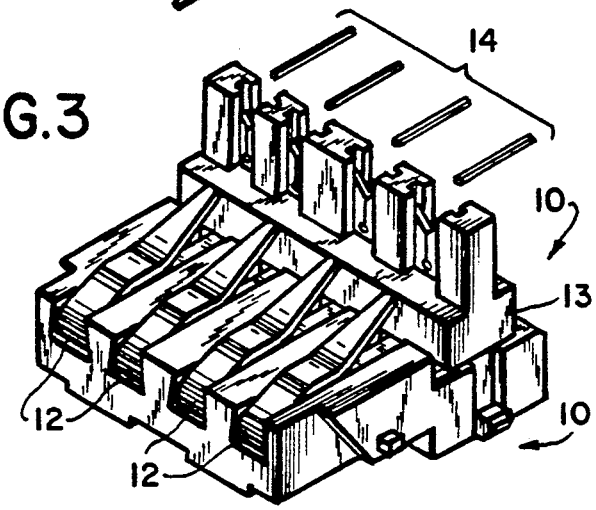
FIG.4
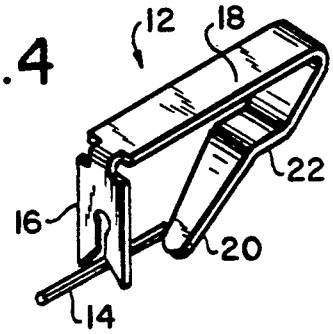
FIG.5
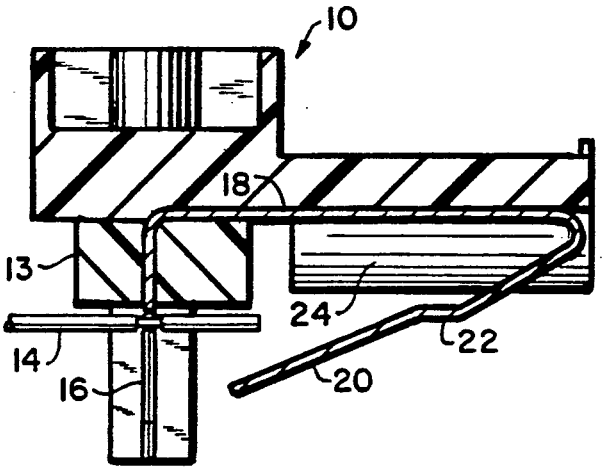
FIG.9
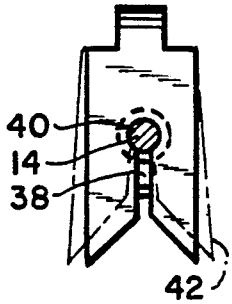
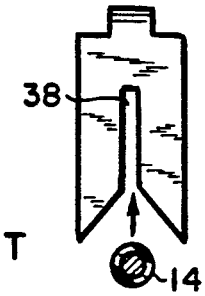
FIG.8
PRIOR ART

ELECTRICAL TERMINAL

BACKGROUND OF THE INVENTION

The present invention relates to an electrical terminal comprising an electrically conductive elongate resilient strip configured to mechanically hold and electrically contact an insulated wire or cable. The invention also relates to an electrical terminal which comprises a base and an electrically conductive, elongate strip attached thereto configured to contact another either similar or dissimilar electrical terminal.

With the ever increasing use of data communications equipment, there is a growing need for electrical connectors for terminating electrical cables and for connecting data equipment, or components thereof, to each other. Electrical connectors of the type used for data communications equipment are shown, for example, in the U.S. Pat. Nos. 4,449,778 and 4,501,459 (reissued as U.S. Pat. No. 32,760). These connectors include a parallel row of four electrical terminals, each of which is configured at one end to mechanically and electrically connect to an insulated wire and configured at the other end to contact another terminal. Between its two ends, each electrical terminal is reversely bent in a U-shaped manner to provide resiliency to the terminal-contacting end. This single-piece terminal has provided reliable, effective service but it exhibits a number of disadvantages.

As a first problem, the terminal is designed to receive and connect to one size of wire only. Thus, an attempt to attach a larger gauge wire to the terminal, for example, is a frustrating experience for the user.

Second, the complicated shape of the terminal, with the cable-attaching end and the U-shaped reverse bend at the other end, makes this terminal somewhat difficult to manufacture. It cannot be made in a single stamping operation but requires at least two manufacturing steps to complete.

SUMMARY OF THE INVENTION

It is an object of the present invention to provide an electrical terminal which facilitates the connection of an electrically insulated wire or cable to another electrical terminal.

It is a further object of the present invention to provide an electrical terminal of the type just described which avoids the disadvantages of such terminals of known design.

These objects, as well as other objects which will become apparent from the discussion that follows, are achieved, according to the present invention, by providing an electrically conductive, elongate, resilient strip having a free first end and a slot, extending in the longitudinal direction from the first end, for receiving the wire or cable. An opening in the strip, which is in communication with the slot, has an internal diameter which is greater than the narrowest width of the slot. This opening therefore not only allows the slot to expand easily upon insertion of an oversized wire, but also itself accommodates an oversized wire and serves as a "detent" to hold the wire on the strip.

To facilitate electrically contacting another terminal, the electrical terminal comprises a first element forming the first end for connection to an insulated wire and a second, separate element forming a second end for contacting another terminal. The first element is rigidly attached to an insulative base and has a third, opposite end for resiliently supporting the second end of the second element. The second element also has a forth end, opposite to its second end, which is rigidly supported by the base.

Further features and advantages of the present invention will be described hereinbelow.

The preferred embodiments of the present invention will now be described with reference to the accompanying drawings.

BRIEF DESCRIPTION OF THE DRAWINGS

FIG. 1 is a perspective view showing the bottom of a terminal base for holding four terminals of the type to which the present invention relates.

FIG. 2 is an end view of the terminal arrangement shown in FIG. 1.

FIG. 3 is a perspective view of the top of a terminal base incorporating terminals of the type to which the present invention relates.

FIG. 4 is a perspective view of a single element terminal incorporating one aspect of the present invention.

FIG. 5 is a cross-sectional view of the terminal of FIG. 4 installed in the base of FIGS. 1–3.

FIG. 8 is an end view of an electrical terminal in accordance with the prior art, having a slot for gripping an insulated wire.

FIG. 9 is an end view of an electrical terminal in accordance with the invention, having an opening to facilitate the gripping of wires of different diameter.

DESCRIPTION OF THE PREFERRED EMBODIMENTS

Figure 6:
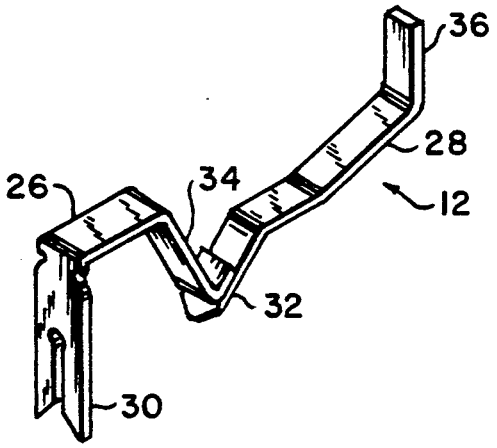
FIG. 6 is a perspective view of a two element terminal in accordance with another preferred embodiment of the present invention.

The preferred embodiments of the present invention will now be described with reference to FIGS. 1–17 of the drawings. Identical elements shown in the various figures are designated with the same reference numerals.

FIGS. 1–3 show different sides of a terminal base 10 which may be attached to an electrical appliance or inserted within the housing of a separate electrical connector. For example, the base 10 may be inserted in a shielded electrical connector of the typed disclosed in the aforementioned U.S. Pat. Nos. 4,449,778 and 4,501,459 (now reissue U.S. Pat. No. 32,760). The base 10 is made of molded plastic and has installed therein four identical contact elements 12 which will be described in detail hereinafter. These contact elements 12 are designed to mechanically and electrically connect with individual insulated electrical wires 14, on one hand, and to resiliently contact other electrical terminals of the same or different type, on the other. The contact elements 12 are retained in position by a separate insulating block 13 of plastic which is snapped into place on the base 10.

Figure 7:
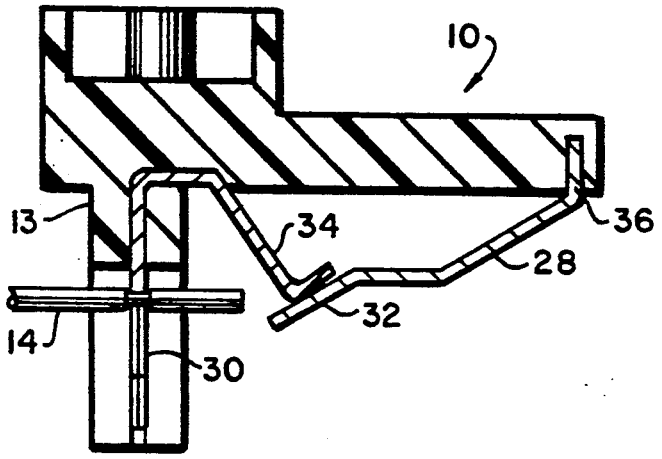
FIG. 7 is a cross-sectional view of the terminal of FIG. 6 installed in a base of the type shown in FIGS. 1–3.

Two types of electrical terminals 12 that can be installed in the base 10 are illustrated in FIGS. 4 and 5, on one hand, and FIGS. 6 and 7 on the other. FIGS. 4 and 5 show a single element electrical terminal which is stamped and formed from sheet metal stock. This terminal comprises an upstanding first end 16 having a wire-receiving slot connected by a neck to a body portion 18 from which extends a reversely bent contact tongue 20 formed with a step 22. This single piece metal element is assembled in the base 10 by inserting the central body member in a slot and thereafter placing the block 13 of plastic over the upstanding end 16.

In order to avoid the necessity of a reverse bend, which necessitates a separate manufacturing step, the terminal 12 is preferably made from two separate, stamped pieces of flat sheet metal. As is shown in FIGS. 6 and 7, the terminal comprises a first element 26 configured to receive an insulated wire and a second element 28 configured to contact another terminal. The first, wire receiving end 30 of the first element 26 and the second, terminal contacting end 32 of the second element 28 are identical to the first and second ends, respectively, of the terminal strip in the embodiment of FIGS. 4 and 5. However, the first element 26 has a third, opposite end 34 for resiliently supporting the second end 32 of the second element 28. The second element 28 also has a fourth end 36, opposite to the second end 32, which is rigidly embedded in, and thereby attached to the base 10.

FIG. 8 shows a traditional electrical terminal for mechanically holding and electrically contacting an electrically insulated wire or cable. This terminal is formed of a flat, electrically conductive, elongate metal strip having a slot 38 extending in the longitudinal direction from the free end for receiving the wire or cable. The end of the strip is cut into a V-shape to facilitate entry of the cable 14. Preferably, the edges of the V-shaped end are cut or machined to form sharp cutting blades that can easily pierce the wire insulation. The sides or edges of the slot 38 are not sharpened so that they will not damage the bare conductor.

The terminal of FIG. 8 is designed to cut and displace the wire insulation when a wire is inserted in the slot. The slot width is designed to receive only one size of wire conductor, however, which is extremely inconvenient in practice since cable assemblies for data communications and the like contain different gauge wires.

Figure 10:
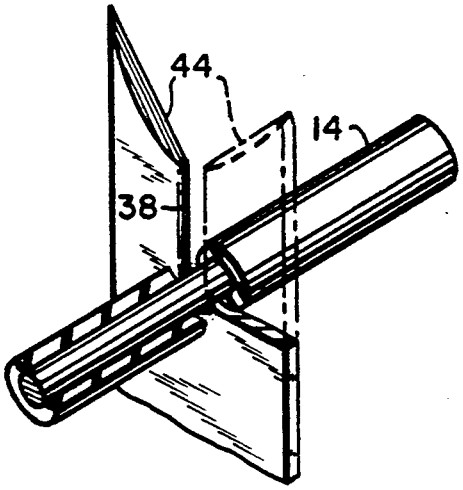
FIG. 10 is a partial cutaway view of the terminal end shown in FIG. 9.

According to the present invention, and as shown in FIGS. 9 and 10, a round opening 40 is provided at the bottom of the slot 38 and the slot is made somewhat narrower in width than in the traditional terminal of FIG. 8. The provision of the opening 40 allows the blades on either side of the slot to expand, as shown by the phantom lines 42 in FIG. 9, during insertion of the wire 14.

Whereas the traditional terminal shown in FIG. 8 provides proper mechanical and electrical connection with only one size of electrical conductor, a terminal according to the present invention, and illustrated in its preferred embodiment and best mode in FIG. 9, is capable of accommodating a range of wire gauges such as 22-26 AWG. This accommodation of a range of wire sizes is due to the fact that the slot 38 is capable of expanding in width due to the opening 40. The diameter of the opening 40 is preferably approximately twice the width of the slot 38.

FIG. 10 shows that the V-shaped ends 44 of the terminal strip are cut or machined to form sharp edges or blades which can pierce the insulation of the wire 14. In contrast, the sides of the slot 38 are flat or rounded so as not to cut into the wire conductor.

Figure 11:
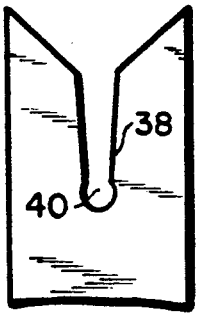
FIG. 11 is a fragmentary view of a terminal end in accordance with a still further preferred embodiment of the present invention.
Figure 12:
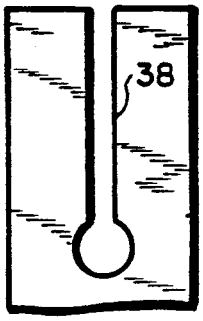
FIG. 12 is a fragmentary view of a terminal end in accordance with a still further preferred embodiment of the present invention.

FIGS. 11–17 illustrate various modifications of the terminal strip end which fall within the concept of the present invention. In FIG. 11 the slot 38 is tapered inward from the V-shaped end of the terminal strip to facilitate insertion of the wire. In FIG. 12, the end of the terminal strip is cut square with a right angle. In this case, one or both side edges of the slot may be sharpened to form a knife blade.

Figure 13:
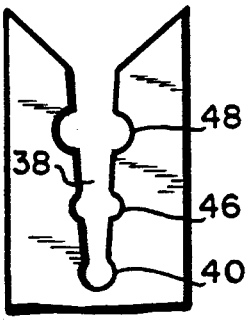
FIG. 13 is a fragmentary view of a terminal end in accordance with a still further preferred embodiment of the present invention.

FIG. 13 shows an embodiment with three round openings 40, 46 and 48 arranged along the course of the slot 38. In this case, the slot is also tapered in the manner of the embodiment illustrated in FIG. 11. The opening 48 is larger than the openings 46 and 40, and the opening 46 is larger than the opening 40. This arrangement expands the range of the wire sizes which are accommodated by the terminal strip.

Figure 14:
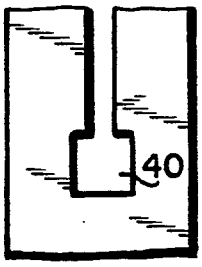
FIG. 14 is a fragmentary view of a terminal end in accordance with a still further preferred embodiment of the present invention.
Figure 15:
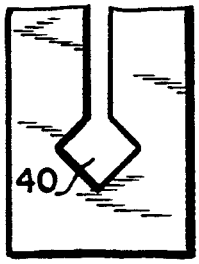
FIG. 15 is a fragmentary view of a terminal end in accordance with a still further preferred embodiment of the present invention.
Figure 16:
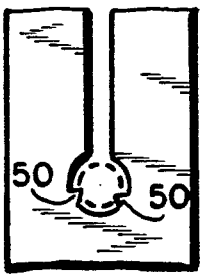
FIG. 16 is a fragmentary view of a terminal end in accordance with a still further preferred embodiment of the present invention.
Figure 17:
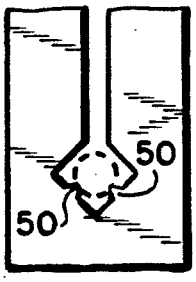
FIG. 17 is a fragmentary view of a terminal end in accordance with a still further preferred embodiment of the present invention.

FIGS. 14–17 show different configurations of the opening 40. FIGS. 14 and 15 show a square opening and FIGS. 16 and 17 shown the provision of projections 50 which point inward to make positive contact with the wire conductor lodged within the opening.

There has thus been shown and described a novel electrical terminal which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In an electrical terminal for mechanically holding and electrically contacting an electrically insulated wire or cable, said terminal comprising an electrically conductive, elongate, resilient, flat strip having a free end and a slot, extending in the longitudinal direction from said free end, for receiving an insulated wire or cable with an electrical conductor surrounded by insulation, the improvement comprising an opening in said strip at the end of said slot for receipt of the electrical conductor of said wire or cable, said opening having an internal diameter which is greater than the narrowest width of said slot; wherein said free end of said strip is V-shaped and said slot commences at the vertex of the V; and wherein the internal edges of the V portion of the strip are sharp, cutting edges for slicing into the insulation of said wire or cable when said wire or cable is pressed into the slot;

whereby the insulation may be separated from the electrical conductor when said wire or cable is pressed into said slot and passed through said slot into said opening.

2. The electrical terminal defined in claim 1, wherein the width of said slot is less than the diameter of the electrical conductor in said wire or cable, whereby the resilience of said strip permits insertion of said wire or cable in said slot.

3. The electrical terminal defined in claim 1, wherein said slot is wider at said free end than in the vicinity of said opening.

4. The electrical terminal defined in claim 1, wherein said opening is substantially round.

5. The electrical terminal defined in claim 1, wherein said opening is substantially square.

6. The electrical terminal defined in claim 1, wherein said opening has at least one projection extending inward toward its center.

7. The electrical terminal defined in claim 1, wherein said projection has a pointed end.

8. The electrical terminal defined in claim 1, wherein said diameter of said opening is approximately twice that of said narrowest width of said slot.

9. The electrical terminal defined in claim 1, wherein said opening is at the end of said slot opposite said free end.

10. The electrical terminal defined in claim 1, wherein there are a plurality of openings in said strip disposed along said slot.

11. The electrical terminal defined in claim 1, wherein said terminal is made of flat sheet metal stock.

12. The electrical terminal defined in claim 1, wherein the sides of said slot are non-cutting edges so as to avoid cutting of said electrical conductor when it is passed through said slot.

13. The electrical terminal defined in claim 1, wherein said strip is attached to a base.

14. The electrical terminal defined in claim 13, wherein said strip is attached to a base at the end thereof opposite said free end.

15. In an electrical terminal for mechanically holding and electrically contacting an electrically insulated wire or cable, said terminal comprising an electrically conductive, elongate, resilient strip having a free end and a slot, extending in the longitudinal direction from said free end, for receiving a wire or cable, the improvement comprising a plurality of openings in said strip in communication with said slot, said openings each having an internal diameter which is greater than the narrowest width of said slot, said plurality of openings in said strip being disposed along said slot, each opening having a different diameter;

whereby a wire or cable may be inserted into one of said openings through said slot.

16. The electrical terminal defined in claim 15, wherein the diameters are arranged from largest to smallest progressing along said strip from said free end.

17. In an electrical terminal for mechanically and electrically contacting another electrical terminal, said terminal comprising a base and an electrically conductive, elongate strip attached to said base and having a first end for connection to a wire or cable and a second end for contacting said other terminal, the improvement wherein said strip comprises a first element forming said first end and a second, separate element forming said second end, said first element being rigidly attached to said base and having a third, opposite end for resiliently supporting said second end of said second element, said second element having a fourth end opposite to said second end which is rigidly attached to said base.

18. The electrical terminal defined in claim 17, wherein said first element has a slot, extending in the longitudinal direction from said first end for accommodating a wire or cable, said first element having an opening therein in communication with said slot, said opening having an internal diameter which is greater than the narrowest width of said slot, whereby a wire or cable may be inserted in said opening through said slot.

19. The electrical terminal defined in claim 17, wherein said second element has a stepped portion adjacent said second end for ensuring positive mechanical engagement with said other terminal.

* * * * *